US005827375A

United States Patent [19]

Barbour

[11] Patent Number: 5,827,375

[45] Date of Patent: Oct. 27, 1998

[54] PROCESS FOR CARBURIZING FERROUS METAL PARTS

[76] Inventor: George E. Barbour, 3200 S. Jerome Rd., Pittsford, Mich. 49271

[21] Appl. No.: 96,337

[22] Filed: Jul. 23, 1993

[51] Int. Cl.[6] ..... C23C 8/22

[52] U.S. Cl. ..... 148/225; 148/235

[58] Field of Search ..... 148/225, 235

[56] References Cited

U.S. PATENT DOCUMENTS

| | | | |
|---|---|---|---|
| 3,290,030 | 12/1966 | Goehring | 266/257 |
| 3,413,161 | 11/1968 | Goehring | 148/235 |
| 4,049,472 | 9/1977 | Arndt | 148/218 |
| 4,306,918 | 12/1981 | Kaspersma et al. | 148/218 |

FOREIGN PATENT DOCUMENTS

| | | | |
|---|---|---|---|
| 24106 | 2/1981 | European Pat. Off. | 148/235 |
| 205187 | 12/1983 | Germany | 148/225 |
| 60-114565 | 6/1985 | Japan | 148/235 |
| 2076023 | 11/1981 | United Kingdom | 148/235 |

OTHER PUBLICATIONS

Metals Handbook : Gas Carburizing, AMS, ninth Edition, vol. 4 1979, pp. 135–175.

Carburizing With Direct–feed Mixtures of Natural Gas and Air, F. Kuhn, Heat Treatment of Metals 1993 pp. 39–44.

*Primary Examiner*—Sikyin Ip

*Attorney, Agent, or Firm*—Rankin, Hill, Porter & Clark LLP

[57] ABSTRACT

The present invention provides a new and improved method of carburizing ferrous metal parts. In one embodiment the invention comprises the steps of heating the process chamber of a furnace to a temperature in excess of about 1100° F., charging such parts to be carburized into the process chamber of the furnace, providing a carrier gas and feeding such carrier gas into the process chamber so as to provide a furnace atmosphere in the process chamber having a carbon potential of at least about 0.5%, providing a source of air and feeding such air to the process chamber so as to raise the carbon potential of the furnace atmosphere by at least 0.1%, and discharging the parts from the furnace. An enriching gas is fed into the process chamber along with the air. The enriching gas is a carbon (C) containing gas that may be decomposed to provide a source of free carbon (C).

15 Claims, No Drawings

PROCESS FOR CARBURIZING FERROUS METAL PARTS

TECHNICAL FIELD

The invention concerns the field of metallurgical heat treating. More particularly, the invention concerns processes for carburizing ferrous metal parts under a controlled atmosphere at elevated temperatures. These processes are commonly referred to as gas carburizing.

BACKGROUND

Carburization is the conventional process for the case hardening of steel. In gas carburizing the steel is exposed to an atmosphere which contains components capable of transferring carbon to the surface of the metal from which it diffuses into the body of the part. An important constituent of the furnace atmosphere used to carburize metal parts is the carrier gas. A carrier gas serves to provide a furnace atmosphere with a positive carbon potential.

A variety of carrier gases have been employed in carburizing as discussed in U.S. Pat. No. 4,049,472, but the most common carrier gas is the endothermic (endo) gas derived by partial combustion of natural gas in air. When using endothermic gas, it is usually necessary to add a relatively small quantity of another constituent (i.e., enriching gas), usually natural gas, to the atmosphere to raise the carbon potential of the furnace atmosphere.

A thorough discussion of carburizing can be found in the section entitled "Furnace Atmospheres and Carbon Control" found at pages 67 through 92, and that portion of, the section entitled "Case Hardening of Steel" appearing at pages 93 through 128 of Volume 2 of the Metals Handbook published in 1964 by the American Society of Metals, Metals Park, Ohio. This particular volume of the Metals Handbook is entitled "Heat Treating, Cleaning and Finishing."

During gas carburization, the steel objects to be carburized are exposed at an elevated temperature, usually in the range of about 1400°–1700° F., until carbon penetration to a desired depth has been achieved. The steel objects can then be cooled to room temperature by various known methods such as a furnace, air or media quench to develop the desired physical properties and case hardness in the finished article.

The basic endothermic atmosphere produced by the incomplete combustion of natural gas in air consists of approximately 40% $N_2$, 40% $H_2$ and 20% CO. The reaction by which carbon is generally believed to be deposited on the surface of the steel is represented by the following equation (1):

$$H_2+CO=C+H_2O \quad (1)$$

The water produced in equation (1) immediately reacts partially with more CO according to the well-known water gas shift reaction (2):

$$H_2O+CO=CO_2+H_2 \quad (2)$$

Equations (1) and (2) may be added together to yield reaction (3):

$$2CO=C+CO_2 \quad (3)$$

The net results of carburization by the endothermic atmosphere is the decomposition of carbon on the surface of the metal and concurrent formation of an equivalent amount of $CO_2$ or $H_2O$. These two substances, $CO_2$ and $H_2O$, cause the reversal of reactions (1) and (3) and if allowed to accumulate, would quickly bring the carburization process to a halt. The purpose of adding enriching gas as mentioned above is to remove the $H_2O$ and $CO_2$ and regenerate more active reactive gases according to reactions (4) and (5):

$$CO_2+CH_4=2CO+2H_2 \quad (4)$$

$$H_2O+CH_4=3H_2+CO \quad (5)$$

Another method of generating a carburizing atmosphere which is discussed in U.S. Pat. No. 4,306,918 involves decomposition of methanol, either alone or in combination with nitrogen, according to equation (6):

$$CH_3OH=2H_2+CO \quad (6)$$

It will be noted that the above reaction (6) results in the production of CO the same as is produced by the use of endothermic atmosphere by partial combustion of natural gas. By use of the appropriate quantities of nitrogen and methanol it is possible to generate a synthetic atmosphere which is essentially identical in composition to that produced by the partial combustion of natural gas.

During operation of a furnace, the carbon potential of the furnace atmosphere can become too high. When the carbon potential becomes too high it can lead to the excessive formation of carbon on the metal parts being carburized and the formation of excess carbon in the interior of the furnace. In order to lower the carbon potential of a furnace atmosphere, it is a common practice to add air to the process chamber of the furnace. Air has also been employed in the prior art in situations where a carrier gas is not generated outside the process chamber. Specifically, air has been used in situations where a combustible gas (e.g., natural gas) is fed into a generator located within the process chamber of the furnace. In such situations, the air serves to decompose the combustible gas in situ in the process chamber of the furnace. Accordingly, in the prior art when a carrier gas has been produced outside the process chamber, air has not been utilized in order to raise the carbon potential of a furnace atmosphere.

SUMMARY

The present invention provides a new and improved method of carburizing ferrous metal parts which affords many distinct advantages over prior art methods. Specifically, the method of the present invention provides shorter carburizing cycles, improved control of carbon potential and avoids carbon clogging of furnace interiors and the clogging and cementing together of the parts that are being carburized.

In one embodiment the invention comprises the steps of heating the process chamber of a furnace to a temperature in excess of about 1100° F., charging such parts to be carburized into the process chamber of the furnace, providing a carrier gas and feeding such carrier gas into the process chamber so as to provide a furnace atmosphere in the process chamber having a carbon potential of at least about 0.5%, providing a source of air and feeding such air to the process chamber so as to raise the carbon potential of the furnace atmosphere by at least 0.1%, and discharging the parts from the furnace.

An enriching gas is fed into the process chamber along with the air. An enriching gas is a carbon (C) containing gas that may be decomposed to provide a source of free carbon (C). The enriching gas may comprise a gas selected from the group consisting of $CH_4$, CO, $C_2H_6$, $C_2H_4$, $C_6H_6$, $C_4H_{10}$, $C_3H_8$ and mixtures of such gas At least about 0.010 cubic feet of the air is fed into the process chamber for about every one cubic foot of the enriching gas that is fed into the process chamber. Preferably, from about 0.020 cubic feet to about 10 cubic feet of the air is fed into the process chamber for about every cubic foot of enriching gas that is fed into the process chamber.

The foregoing and other features of the invention are hereinafter more fully described and particularly pointed out in the claims below. The following description sets forth in detail certain illustrative embodiments of the invention, these being indicative, however, of but a few of the various ways in which the principles of the invention may be employed.

DETAILED DESCRIPTION

The principles of the present invention may be practiced in conjunction with various furnaces and with various types of carrier gases.

The furnaces with which the present invention may be employed include batch-type furnaces (box furnaces), rotary furnaces, continuous furnaces (pusher-type), pit furnaces and vacuum furnaces. These furnaces generally have heating and cooling means, one or more process chambers in which the workpieces are placed on a hearth or platform, or suspended, and exposed to heat and carburizing atmosphere, and one or more doors or accesses through which the steel parts pass into or out of the chamber. In addition to the foregoing, there are usually vents to avoid pressure buildup, vestibules between the doors to the chamber and the outer doors to the furnace, and circulating fans to expedite gas phase mass transfer and heat transfer.

The pusher-type (continuous) furnace differs from the other furnaces only in that it has a series of chambers and doors through which the steel parts are pushed from one end of the furnace to the other. Another important difference between batch furnaces and continuous furnaces is that in batch furnaces carburizing does not begin until the furnace reaches the carburizing temperature, which is typically about 30 minutes after the doors are closed, and there is no door opening until the end of the carburization cycle. On the other hand, in the continuous furnaces, doors are opened and closed frequently, typically about every hour.

The carburizing chambers or process chambers of the furnaces are "closed," which means that vents or any other openings through which gases can pass into or out of the chamber are closed and kept closed throughout the process except, of course, for the passages, door or other openings, through which the steel parts pass into or out of the chamber; gas inlet ports necessary to provide the carburizing atmosphere; and sample ports commonly used for testing purposes. The objective of the "closed" chamber is to keep the influx of oxidizing to a minimum and limit losses of carburizing atmosphere. When practicing the present invention, preferably, the process chamber is kept "closed" as much as possible to prevent the uncontrolled outflow of furnace atmosphere and the uncontrolled influx of air.

Door opening and closing and the introduction of the steel workpieces or load may be accomplished manually or automatically, but is, again, conventional as is the internal temperature of the process chamber where the carburizing takes place. This temperature lies within a range of about 1100° F. to about 2200° F. and is generally about 1500° F. to about 1850° F.

Carburizing time is about 0.5 to about 50 hours and is typically about 3 to about 9 hours. Particular times, however, are selected according to the depth of case desired, the composition of the parts being carburized and the carrier and enriching gases being utilized.

The gases that can be used in connection with the present invention include the carrier gases discussed in U.S. Pat. Nos. 4,049,472 and 4,306,918, the disclosures of which are incorporated herein by reference.

One suitable carrier gas is an exothermic base gas which is formed by partial or complete combustion of a fuel gas/air mixture. These mixtures may have the water vapor removed to produce a desired dew point in the atmosphere. Another suitable carrier gas is a prepared nitrogen base atmosphere which is an exothermic base with carbon dioxide and water vapor removed. Another suitable carrier gas is an endothermic carrier gas which is formed by partial reaction of a mixture of fuel gas and air in an externally heated catalyst filled chamber. Another suitable carrier gas is a charcoal based atmosphere which is formed by passing air through a bed of incandescent charcoal. Another suitable carrier gas is an exothermic-endothermic base atmosphere formed by complete combustion of a mixture of fuel gas and air, removing the water vapor, and reforming the carbon dioxide to carbon monoxide by means of a reaction with fuel gas in an externally heated catalyst filled chamber. Another suitable carrier gas is an ammonia base atmosphere which can be formed by raw ammonia, dissociated ammonia, a partially or completely combusted dissociated ammonia with a regulated dew point. The carrier gas may also be of a type which is formed in situ by the decomposition of a hydrocarbon liquid at elevated temperatures. These above gases and others which provide a carburizing atmosphere in a furnace are generically referred to in this specification and the claims below as a "carrier gas." As used in this specification and the claims below the term "carrier gas" means a gas media which in and of itself is capable of providing a neutral or positive carbon potential within the process chamber of a furnace.

In order to impart carbon into the ferrous metal parts which are to be carburized, the furnace atmosphere contained within the process chamber must have a carbon potential. Carbon potential is a measure of the ability of a carburizing gas to increase the carbon level of the ferrous metal parts. The carbon potential will depend on such factors as the temperature of the furnace atmosphere, the dew point of the furnace atmosphere, and the amount of carbon (C) contained in the furnace atmosphere. As the dew point goes down, the carbon potential increases. For purposes of this specification and the claims below "carbon potential" is defined as the weight percent carbon dissolved on a steel surface which is in equilibrium with the furnace atmosphere. The actual carbon potential of a furnace may be measured using various conventional means such as, for example, infrared analyzers and dew point analysis using various conventional means such as a dew cup instrument, a fog chamber, a chilled-mirror apparatus or a chilled-metal apparatus.

The carbon potential of the furnace atmosphere in the process chamber of a furnace is attained and maintained by using an enriching gas with the carrier gas. The enriching gas is generally a gas selected from the group consisting of $CH_4$, CO, $C_2H_6$, $C_2H_4$, $C_6H_6$, $C_4H_{10}$, $C_3H_8$ and mixtures of such gases. A preferred enriching gas is methane ($CH_4$) because of its cost and availability.

With the proper amount of enriching gas flowing or being fed into the process chamber of the furnace, air is fed into the process chamber. The air is fed into the process chamber at the rate of at least about 0.010 cubic feet of air for every 1 cubic foot of enriching gas that is fed into the process chamber. Preferably, from about 0.020 cubic feet to about 10 cubic feet of air is fed into the process chamber for about every 1 cubic foot of enriching gas that is fed into the process chamber. More preferably, from about 0.03 cubic feet to about 7 cubic feet of air is added for about every cubic foot of enriching gas added. Further preferred, from about 0.05 cubic feet to about 5 cubic feet of air is added for about every cubic foot of enriching gas added. It will be appreciated that the specific ratio of air to enriching gas may vary and will be dependent upon such factors as the dew point in the carrier gas, the specific enriching gas being utilized, and the quality of the seal that the furnace is capable of maintaining (i.e., the ability of the furnace to prevent furnace atmosphere leakage or the ingress of gases into the carburizing chamber).

A preferred method of determining the carbon potential of the furnace atmosphere is by using a conventional oxygen probe. Another common method of determining the carbon potential is by monitoring the dew point. Generally, the lower the dew point, the higher the carbon potential of the furnace atmosphere. With the dew point in the process chamber of the furnace at zero, carbon will form quite rapidly and depending on the particular application the carbon may form excessively. Of course, excess carbon formation can be controlled by turning off the addition of enriching gas and air to the process chamber.

Prior to introducing the air into the process chamber, the carrier gas should provide the furnace atmosphere with a carbon potential which is at least neutral (i.e., at least 0). Preferably, the carrier gas provides a furnace atmosphere with a carbon potential of at least about 0.5%. More preferably, the carrier gas provides a furnace atmosphere with a carbon potential of at least about 0.8%. Further preferred, the carrier gas provides a carbon potential of at least about 1.2.

Upon introduction of the air and enriching gas into the process chamber the air and enriching gas raise the carbon potential of the furnace atmosphere by at least about 0.1%, preferably by at least about 0.2% and more preferably by at least about 0.3%. The air and the enriching gas are fed into the process chamber for at least ten minutes, and preferably for at least one (1) hour. While the air and enriching gas are being fed to the process chamber, the carrier gas is also being fed to the process chamber. The air and enriching gas are fed at a rate of from about 0.01 cubic feet to about 100 cubic feet of air and enriching gas to every 1 cubic foot of carrier gas fed to the process chamber, and preferably from about 0.03 cubic feet to about 75 cubic feet of air and enriching gas are fed to about every 1 cubic foot of carrier gas fed to the process chamber. Of course, as the size of the load of parts being processed increases, the rate at which the air and enriching gas are fed into the process chamber will generally be increased.

The air and the enriching gas should be added simultaneously as a mixture to the process chamber (i.e., the air and enriching gas are fully mixed prior to introduction into the process chamber). The enriching gas and air mixture can be added to the process chamber through a separate inlet or they may be added together along with the carrier gas or mixed with the carrier gas prior to being fed into the process chamber. Preferably, the air and enriching gas mixture are added simultaneously along with the carrier gas. However, it will be appreciated that the air and enriching gas mixture need not be fed simultaneously to the process chamber along with the carrier gas. For example, the air and enriching gas mixture may be "pulsed" to the process chamber. Specifically, for example, the air and enriching gas mixture could be fed to the process chamber for a specific period followed by feeding the carrier gas alone for a specific period to the process chamber, or vice versa.

The process is capable of being used to carburize any type of ferrous metal that is currently being carburized using conventional carburizing techniques. The process of the present invention is in no way limited to any particular class or grade of steel.

By way of illustration and not by any limitation, the following Example will describe a method of carburizing ferrous metal parts within the scope of the present invention.

ILLUSTRATIVE EXAMPLE 1

The furnace comprises a batch-type furnace. Such furnace includes a process chamber or main heating zone having a volume of 100 cubic feet. A 5 horsepower fan is employed to provide good circulation of the gases contained within the process chamber.

Carburizing gas is formed utilizing a conventional endothermic generator. The endothermic generator provides a carburizing gas comprising in volume about 18% carbon monoxide (CO), about 40% hydrogen ($H_2$), about 30% nitrogen ($N_2$), about 0.2% carbon dioxide ($CO_2$) and about 30% methane ($CH_4$).

The process chamber is heated to a temperature of about 1750° F. and about 1000 pounds of ferrous metal parts comprising 1020 steel (about 3 pounds each in size having a surface area of about 8 square inches) are charged into the furnace.

The carrier gas is fed into the process chamber so as to provide a positive pressure in the process chamber of about one inch of water column and a dew point of 25°. A mixture of air and methane is then fed into the process chamber along with the carrier gas through the carrier gas inlet so as to lower the dew point of the atmosphere within the process chamber to 5°. The mixture of air and methane comprises about 20% by volume air. The methane is fed at a rate of 30 CFH and the carrier gas is fed at a rate of 100 CFH. The furnace is held at 1750° F. and the air-methane mixture and carrier gas are fed for about eight hours into the process chamber. The supply of air and methane to the process chamber is then shut off. The furnace is then cooled to about 1500° F. and the parts are then quenched into a quench oil and then the parts are removed. The parts display an effective case depth of at least 0.035 inches.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

What is claimed is:

1. A method of carburizing ferrous metal parts in a furnace having a process chamber in which the ferrous metal parts are carburized comprising the steps of:

i.) heating the process chamber to a temperature in excess of about 1100° F.;

ii.) charging the ferrous metal parts to be carburized into the process chamber;

iii.) providing a carrier gas comprising an endothermic carrier gas formed-by partial reaction of fuel gas and air in an externally heated catalyst filled chamber, and feeding the carrier gas into the process chamber so as to provide a furnace atmosphere in the process chamber having a dew point and having a carbon potential of at least about 0.5%;

iv.) providing a source of air and a source of enriching gas and feeding the air and the enriching gas simultaneously to the process chamber so as to raise the carbon potential of the furnace atmosphere in the process chamber by at least about 0.1%; and v.) discharging the ferrous metal parts from the furnace.

2. A method as set forth in claim 1 wherein said enriching gas is selected from the group consisting of $CH_4$, CO, $C_2H_6$, $C_2H_4$, $C_6H_6$, $C_4H_{10}$, $C_3H_8$ and mixtures thereof.

3. A method as set forth in claim 1 wherein during said step iv at least about 0.010 cubic feet of the air is fed for about every 1 cubic foot of the enriching gas that is fed into the process chamber.

4. A method as set forth in claim 1 wherein during said step iv from about 0.020 cubic feet to about 10 cubic feet of the air is fed for about every cubic foot of the enriching gas that is fed into such process chamber.

5. A method as set forth in claim 1 wherein during said step iv from about 0.030 cubic feet to about 7 cubic feet of the air is fed for about every cubic foot of the enriching gas that is fed into the process chamber.

6. A method as set forth in claim 1 wherein the enriching gas and the air are fed simultaneously to the process chamber along with the carrier gas.

7. A method as set forth in claim 1 wherein the air of said step iv is fed to the process chamber for a period of at least about ten minutes.

8. A method as set forth in claim 1 wherein the air of said step iv is fed to the process chamber for a period of at least about 1 hour.

9. A method as set forth in claim 1 wherein the furnace comprises a furnace selected from the group consisting of a rotary furnace, a continuous furnace and a batch furnace.

10. A method of carburizing ferrous metal parts in a furnace having a process chamber in which the ferrous metal parts are carburized comprising the steps of:

i.) heating the process chamber;

ii.) charging the ferrous metal parts to be carburized into the process chamber;

iii.) providing a carrier gas comprising an endothermic carrier gas formed by partial reaction of fuel gas and air in an externally heated catalyst filled chamber and feeding the carrier gas into the process chamber so as to provide a furnace atmosphere in the process chamber having a carbon potential of at least about 0.5%;

iv.) providing a source of air and providing a source of enriching gas and feeding the air and the enriching gas to the process chamber so as to raise the carbon potential of the furnace atmosphere by at least about 0.1% and lower the dew point of the furnace atmosphere by at least about 1° F., the air being added to the process chamber at a rate of from about 0.20 cubic feet to about 10 cubic feet of the air per cubic foot of the enriching gas fed to the process chamber; and v.) discharging the ferrous metal parts from the furnace.

11. A method as set forth in claim 10 wherein during said step iv the carbon potential of the furnace atmosphere contained within the process chamber is increased by at least about 0.2%.

12. A method as set forth in claim 11 wherein during said step iv the carbon potential of the furnace atmosphere contained within the process chamber is increased by at least about 0.3%.

13. A method as set forth in claim 10 wherein during said step iv the carrier gas is also fed to the process chamber, the air and the enriching gas being fed at a rate of from about 0.01 cubic feet to about 100 cubic feet of the air and the enriching gas for every 1 cubic foot of the carrier gas fed to the process chamber.

14. A method as set forth in claim 10 wherein during said step iv the carrier gas is also fed to the process chamber, the air and the enriching gas being fed at a rate from about 0.03 cubic feet to about 75 cubic feet of the air and the enriching gas for about 1 cubic foot of the carrier gas fed to the process chamber.

15. A method as set forth in claim 10 wherein during said step i the process chamber is heated to a temperature of about 1500° F. to about 1850° F.

* * * * *